US006805388B1

(12) United States Patent
Lane

(10) Patent No.: US 6,805,388 B1
(45) Date of Patent: Oct. 19, 2004

(54) DOOR HANDLE PIN RETAINER

(75) Inventor: Christopher M. Lane, Nashua, IA (US)

(73) Assignee: Tri/Mark Corporation, New Hampton, IA (US)

( * ) Notice: Subject to any disclaimer, the term of this patent is extended or adjusted under 35 U.S.C. 154(b) by 0 days.

(21) Appl. No.: 10/288,881

(22) Filed: Nov. 6, 2002

Related U.S. Application Data

(62) Division of application No. 10/126,358, filed on Apr. 19, 2002.

(51) Int. Cl.[7] ..... E05B 3/00

(52) U.S. Cl. ..... 292/348; 292/349; 292/DIG. 64; 292/353

(58) Field of Search ..... 292/336.3, 336.5, 292/347, 348, 349, 355, DIG. 2, DIG. 10, DIG. 38, DIG. 53, 353, DIG. 64, DIG. 31; 411/372.5, 351, 512, 356; 16/380; 403/408.1, 292, 294

(56) References Cited

U.S. PATENT DOCUMENTS 4,475,754 A * 10/1984 Arlauskas et al. ..... 292/336.3
4,682,687 A * 7/1987 Leege et al. ..... 198/852
4,697,948 A * 10/1987 Fukuda ..... 403/71
4,834,433 A * 5/1989 Keller ..... 292/336.3
5,131,785 A * 7/1992 Shimazaki ..... 403/326
5,518,332 A * 5/1996 Katoh ..... 403/155
5,586,458 A * 12/1996 Weinerman et al. ..... 70/208
5,593,264 A * 1/1997 Schlegel et al. ..... 411/522
6,059,329 A * 5/2000 Spitzley ..... 292/336.3
6,132,128 A * 10/2000 Burrows ..... 403/96
6,141,914 A * 11/2000 Feige et al. ..... 49/503
6,152,501 A * 11/2000 Magi et al. ..... 292/336.3
6,240,755 B1 * 6/2001 Da Silva ..... 70/423
6,357,955 B1 * 3/2002 Hoffmann et al. ..... 403/79
6,447,030 B1 * 9/2002 Meinke ..... 292/347
6,530,251 B1 * 3/2003 Dimig ..... 70/237

* cited by examiner

*Primary Examiner*—Gary Estremsky
(74) *Attorney, Agent, or Firm*—McKee, Voorhees & Sease, P.L.C.

(57) ABSTRACT

The door handle assembly includes a housing and a lever handle pivotally connected to the front side of the housing by a pin. A pivot plate is pivotally connected to the back side of the housing, which includes a curved channel in which is mounted a compression spring. The pivot plate covers the channel so as to retain or close the spring in the channel. The pivot plate includes an arm which is linked to the door latch. Upon actuation of the handle, the pivot plate is pivoted by a leg of the handle extending through the housing. The pivotal movement of the pivot plate compresses the spring between one end of the channel and an arm on the pivot plate. The linkage between the pivot plate and the door latch releases the latch when the pivot plate is rotated by actuation of the handle. Upon release of the handle, the compression spring biases the pivot plate to its normal at-rest position. A resilient, integrally formed pin retention member extends from the housing for retaining the door handle pin in position. As the pin is inserted in aligned holes in the housing and the handle and the pinhead is pushed beyond the pin retention member so as to be captured thereby in a single step to preclude accident removal or inadvertent loss of the pin from the holes, without the use of additional hardware to retain the pin.

17 Claims, 5 Drawing Sheets

DOOR HANDLE PIN RETAINER

CROSS-REFERENCE TO RELATED APPLICATIONS

This application is a Division of Ser. No. 10/126,358 filed on Apr. 19, 2002.

BACKGROUND OF THE INVENTION

Door handles for vehicles such as tractors, construction vehicles, recreational vehicles, buses, heavy duty trucks, and utility and emergency vehicles typically include a housing mounted in the door of the vehicle. A lever-type handle is pivotally mounted to the housing and operatively connected to a pivot plate pivotally mounted on the back side of the housing located inside the door. The pivot plate is linked to the door latch, such that upon actuation of the handle, the pivot plate pivots to release the latch. The pivot plate and latch are normally biased to a closed position such that upon release of the handle by the operator, the latch and pivot plate automatically return to the closed position.

The bias to the pivot plate is conventionally provided by an extension spring having one end secured or attached to the housing and the opposite end secured or attached to the pivot plate. Such extension springs have been used in radial applications wherein the opposite ends of the spring are fixed and the body of the spring is curved around a pipe or other wall. Door handles using extension springs have several problems associated therewith. First, the extension spring may be subjected to tooling marks which ultimately lead to fracture. Also, the springs generally fatigue over repeated cycles, which leads to failure. Also, the housing must be relatively stronger due to the increased forces as the spring is extended upon actuation of the door handle.

Another problem with extension springs is that one or both ends of the spring may become detached from the housing or the pivot plate during shipping of the door handle, before installation in the vehicle door. Also, an exposed spring may be subject to getting bumped in application.

It has also been known to use compression springs in a straight channel, such as for use with sliding plunger or bolt-type door handles. This application of compression springs is subjected only to linear forces, since there is no pivotal action in such a door handle assembly.

The handle is pivotally mounted in the housing with a pin. The pin normally is retained in position by a clip or other hardware. The assembly process therefore requires two steps, with the pin first being inserted through aligned holes in the housing and the handle, and then the retention clip or hardware being installed on the pin. Thus, the retention clip or hardware and the second assembly step add to the cost of the door handle assembly.

Therefore, a primary objective of the present invention is the provision of an improved lever-type door handle assembly.

Another objective of the present invention is the provision of an improved door handle assembly utilizing a compression spring in a radial channel.

Another objective of the present invention is the provision of a door handle assembly wherein the biasing spring is retained by the pivot plate in a curved channel.

Another objective of the present invention is the provision of an improved door handle assembly using a compression spring which is less subject to fracture or failure, as compared to an extension spring.

Another objective of the present invention is the provision of an improved pin retention member for a door handle assembly.

Another objective of the present invention is the provision of a pin retention member for a door handle assembly which is integrally molded with the door handle housing.

Another objective of the present invention is the provision of a pin retention member on a door housing assembly which allows the pin to be installed in the housing and handle, and retained in position in a single step.

Another objective of the present invention is the provision of an improved door handle assembly wherein the door handle pin is retained in position without the use of hardware, such as a push-on retainer, mechanical stake, or rivet.

A further objective of the present invention is the provision of an improved door handle assembly wherein the handle is mounted to the housing by inserting and retaining a pin in a single step.

Another objective of the present invention is a method of assembling a door handle to a door handle housing using a pin, wherein the pin is automatically retained when installed through the housing and handle.

Another objective of the present invention is a method assembling a door handle to a housing by installing and retaining a pin in a single step without a secondary step or operation.

A further objective of the present invention is the provision of an improved door handle assembly which is quick and easy to assemble, economical to manufacture, and durable in use.

These and other objectives will become apparent from the following description of the invention.

SUMMARY OF THE INVENTION

The improved door handle assembly of the present invention includes a housing with front and back sides. A handle is pivotally connected to the front side of the housing. An open channel is formed on the back side of the housing for receipt of a compression spring. A pivot plate is pivotally mounted on the back side of the housing in covering relation to the channel so as to retain the compression spring in the channel. A leg on the handle extends through the housing to engage the pivot plate, and thereby pivot the plate upon actuation of the handle. The pivot plate is linked to a door latch such that when the door handle is actuated, the pivot plate releases the door latch.

The handle is pivotally attached to the housing by a pin. The housing includes a pin retention member for automatically retaining the pin when the pin is inserted through aligned holes in the housing and the handle. The pin retention member is a tab integrally molded with the housing and having a notch through which the pin is pushed for insertion into aligned holes in the handle and housing. The head of the pin is retained by the tab so as to preclude removal or falling of the pin from its position.

The present invention also includes a method for assembling the door handle to the housing, including inserting the pin through the aligned holes in the handle of the housing and retaining the pin in position, with the insertion and retention of the pin being a single step.

DETAILED DESCRIPTION OF THE INVENTION

Figure 1:
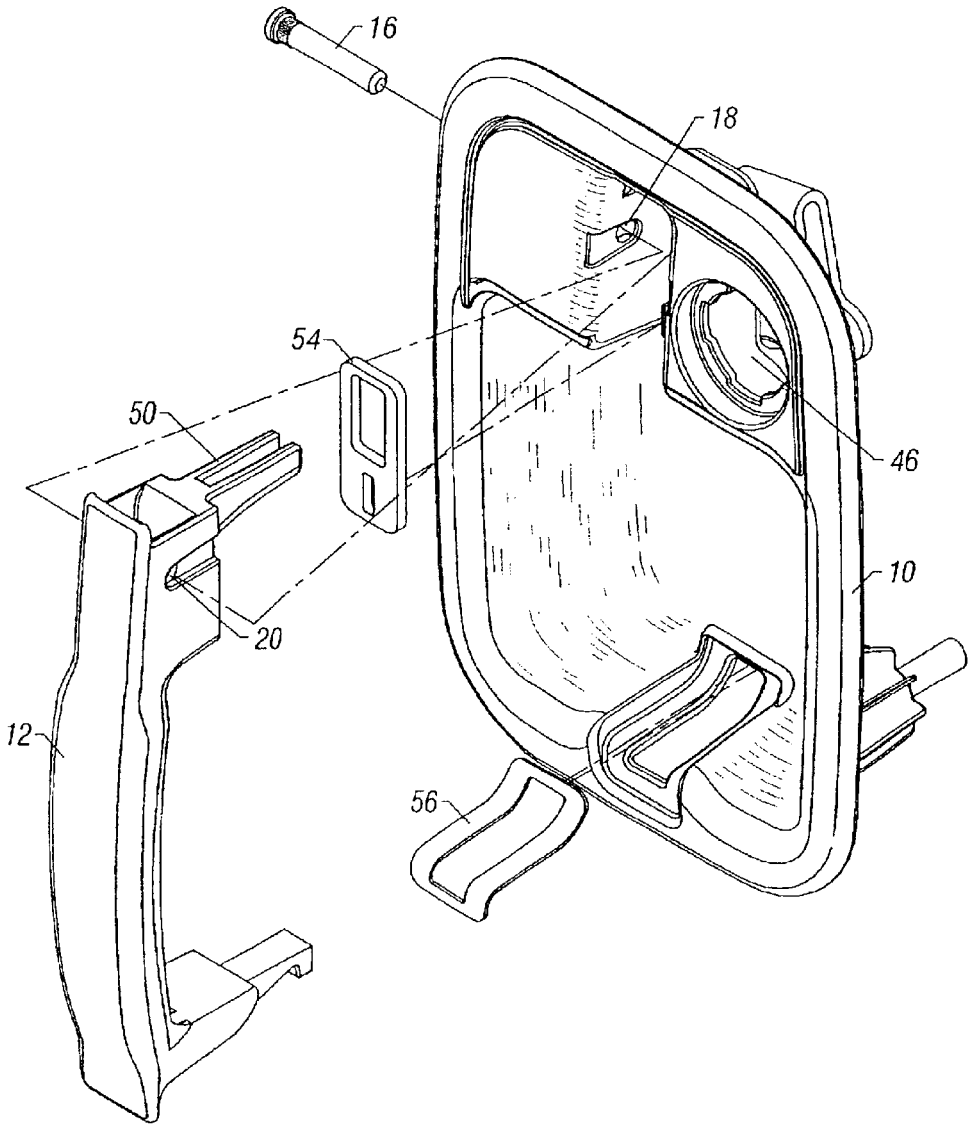
FIG. 1 is an exploded perspective view of the front side of the door handle assembly of the present invention.
Figure 2:
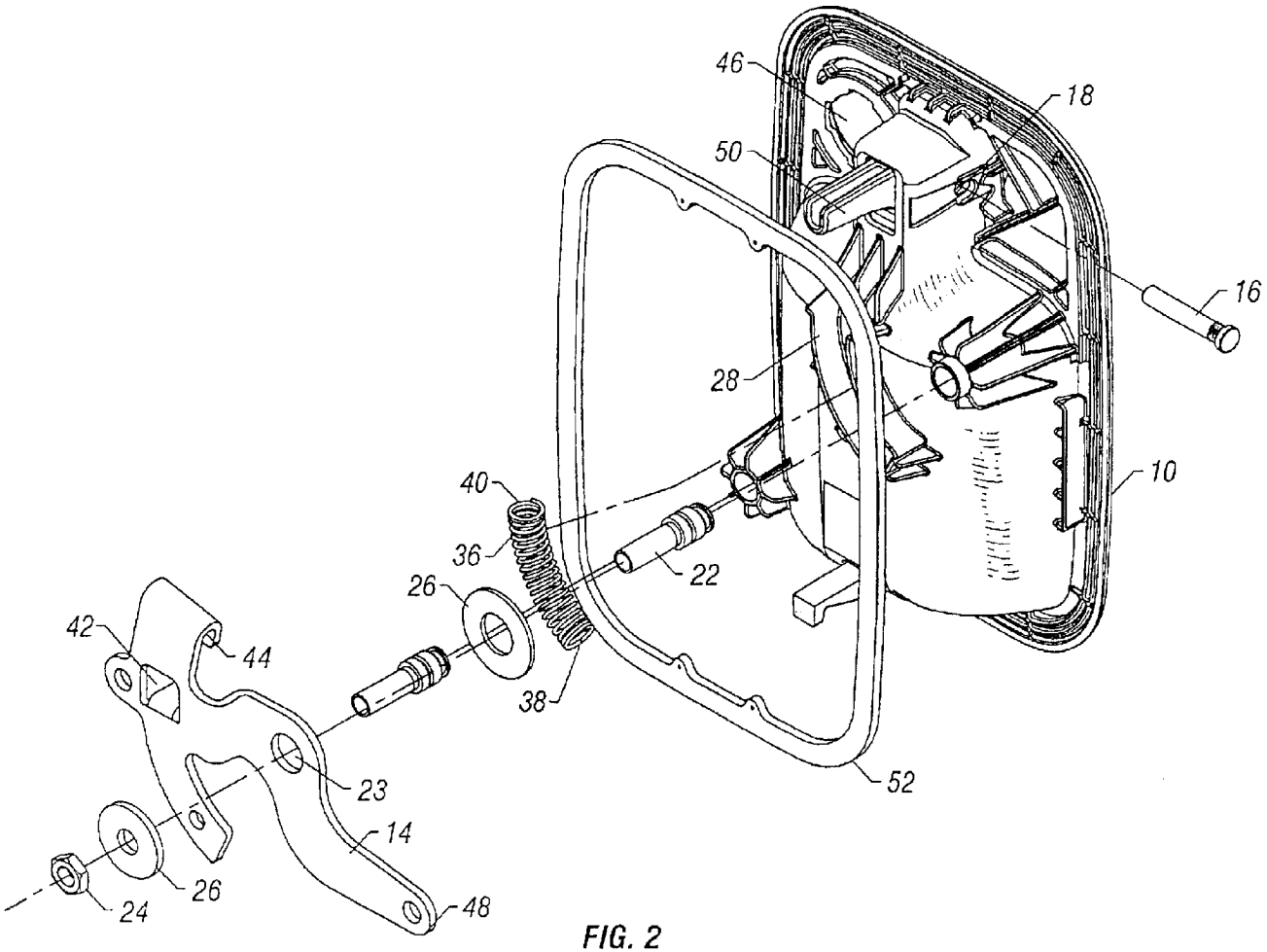
FIG. 2 is a rear perspective exploded view of the door handle assembly of the present invention.
Figure 3:
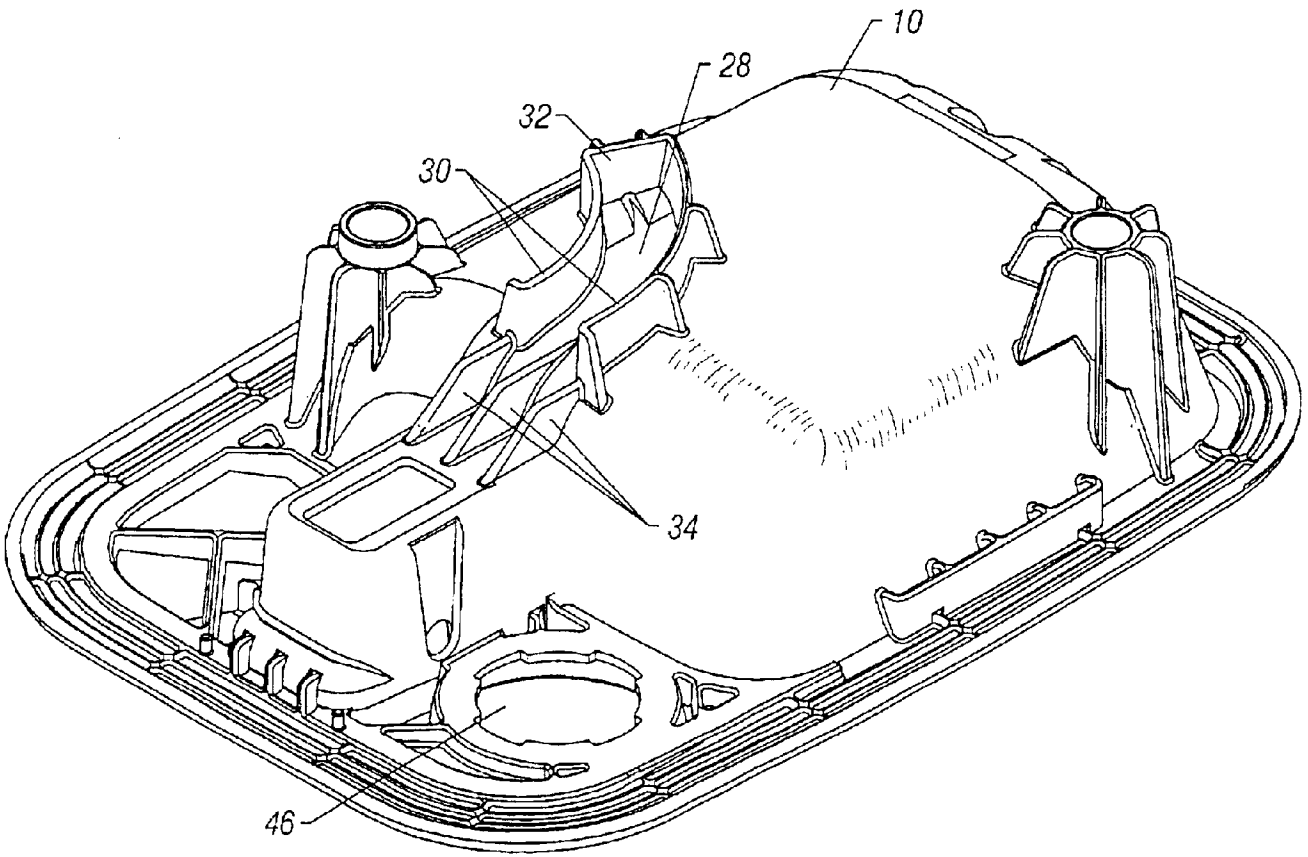
FIG. 3 is a rear perspective view of the housing of the door handle assembly of the present invention.

The door handle assembly of the present invention generally includes a housing 10, a lever-type handle 12 and a pivot plate 14. The handle 12 is pivotally mounted on the front side of the housing 10 by a pin 16 extending through holes 18 in the housing 10 and a hole 20 in the handle 12. The pivot plate 14 is pivotally connected to the back side of the housing 10 with a threaded bolt or stud 22 extending through a hole 23 in the plate 14 and a nut 24. Nylon bushings or washers 26 are positioned on each side of the pivot plate 14 to minimize friction during pivotal movement of the plate.

An open curved channel 28 is formed on the back side of the housing 10. The channel 28 has opposite side walls 30 and one end wall 32. The channel 28 has an opposite end defined by one or more projections 34 extending from the back side of the housing 10.

Figure 4:
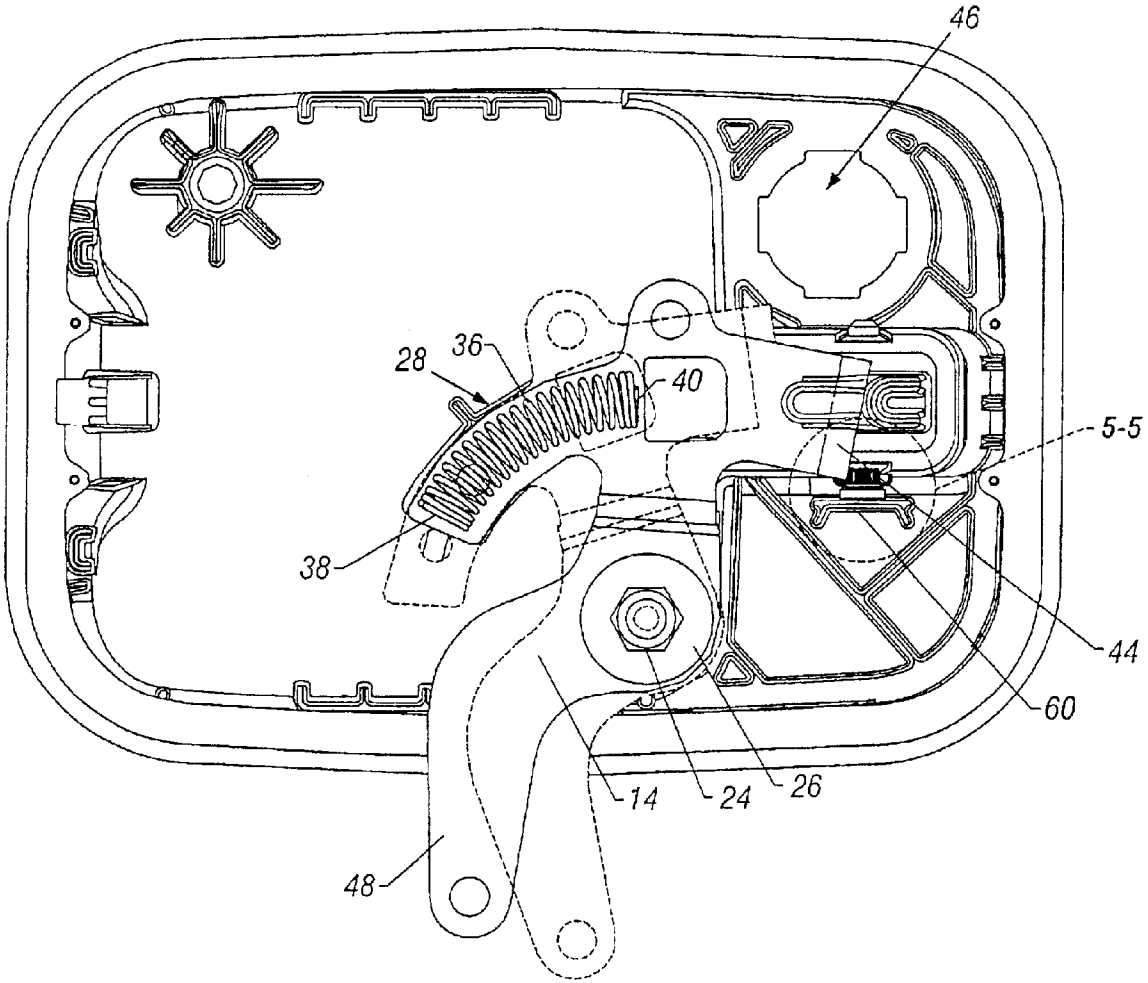
FIG. 4 is a rear plan view of the assembly.

A compression spring 36 is captured in the channel 28 and is retained therein by the pivot plate 14 which lies in covering relation to the channel 28, as best seen in FIG. 4. One end 38 of the spring engages the end wall 32 of the channel 28. The opposite end 40 of the spring 36 engages a forwardly turned arm or tab 42 on the pivot plate 14 which extends into the channel 28.

A key operated lock (not shown) is installed in the key lock hole 46 and connects to a latch/linkage logic (not shown) by a connecting rod or cable that provides the locking/unlocking function independent of the door handle function. This allows the door handle to function or free-float when the latch/door is locked. The pivot plate 14 also has a latch actuation arm 48 which is linked to the door latch (not shown) by a connecting rod or cable.

The handle 12 includes a leg 50 extending through the housing 10 and engaging the curved flange 44 of the pivot plate 14. Thus, when the handle 12 is actuated by pivoting around the pin axle 16, the leg 50 of the handle 12 pushes the curved flange 44 of the pivot plate 14, such that the pivot plate pivots about the bolt 22 in a counter clockwise direction, as seen in FIG. 4. During the counter clockwise rotation of the pivot plate 14, the arm 42 of the plate 14 causes the spring 36 to be compressed between the end wall 32 of the channel 28 and the arm 42. The side walls 30 of the channel 28 control the compression of the spring 36. The rotation of the pivot plate 14 to the position shown in broken lines in FIG. 4 releases the door latch (not shown). The spring 36 biases the pivot plate 14 clockwise, as seen in FIG. 4, such that once handle 12 is released, the pivot plate 14 will rotate clockwise, to allow the door latch to return to its closed position.

The door handle assembly also includes a perimeter gasket 52 to seal the door handle from the weather when the assembly is mounted in a vehicle door. A pair of handle gaskets 54, 56 further seal the interior of the door from the weather when the door handle assembly is mounted in the vehicle door.

Figure 5:
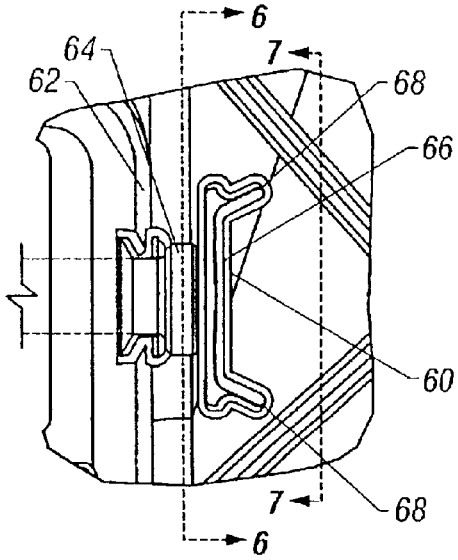
FIG. 5 is an enlarged view taken along lines 4—4 of FIG. 4.
Figure 6:
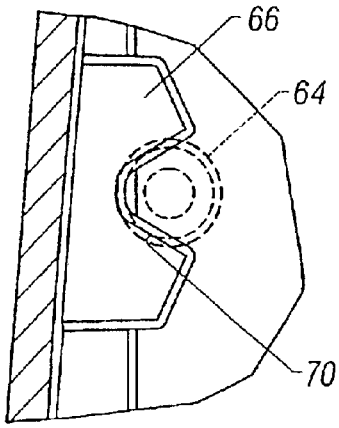
FIG. 6 is a view taken along lines 5—5 of FIG. 5.
Figure 7:
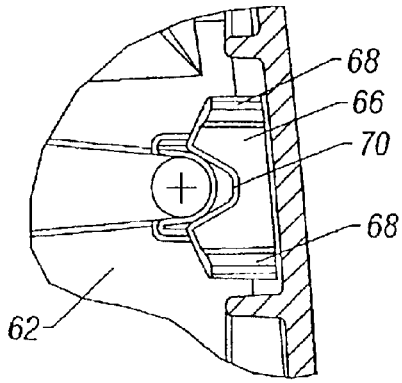
FIG. 7 is a view taken along lines 6—6 of FIG. 5, with the pin removed.

The present invention is further directed towards a pin retention member or retainer 60 on the rearward side of the housing 10. Preferably, the retention member 60 is integrally molded with the housing 10, such that the housing 10 and the retainer 60 have a one-piece construction. As best seen in FIGS. 5–7, the retainer 60 is spaced apart from a wall 62 of the housing having one of the holes 18 for receipt of the pins 16. The distance between the retaining member 60 and the wall 62 is slightly greater than the thickness of the pin head 64, as best seen in FIG. 5.

The pin retainer 60 is generally in the form of a tab having a body 66 and support legs 68 extending angularly from the body 66 so as to provide structural support for the body 66. The body 66 is resilient or flexible and includes a notch or recess 70, as best seen in FIGS. 6 and 7. The notch 70 is dimensioned so as to be slightly smaller than the head 64 of the pin 16. Thus, when the pin 16 is inserted through the holes 18 in the housing and hole 20 in the handle 12 so as to connect the handle 12 to the housing 10, the head 64 of the pin 16 is pushed with light force through the notch 70 of the retention member 60. The resiliency of the retention member 60 allows the pin head 64, which is slightly larger than the notch 70, to pass over or through the notch 70, such that the head resides between the body 66 of the retention member 60 and the wall 62 of the housing 10. Since the notch 70 of the retention member 60 is smaller than the pinhead 64, the retention member 60 functions to retain the pin 16 in position and preclude accidental removal or falling out of the pin 16.

In assembling the handle 12 to the housing, the pin 16 is inserted into the housing holes 18 and the handle hole 20, with the head 64 of the pin 16 being pushed past the retainer 60, all in a single step. The pin 16 is automatically captured and retained by the retainer 60, without the use of additional hardware, such as clips. Thus, the retention member 60 of the present invention eliminates the clip component of the prior and eliminates the second step of installing the clip on the pin, as in the prior art.

Therefore, it can be seen that the present invention accomplishes at least all of the stated objectives.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. An improved door handle assembly including a housing and a handle pivotally attached to the housing by a pin extending through aligned apertures in the housing and handle, the improvement comprising:

a single retainer on the housing past which the pin is inserted to retain the pin against longitudinal removal from the housing and handle, the pin being inserted in a first direction past the retainer to prevent longitudinal movement of the pin in an opposite second direction;

the housing including wall with one of the aperture through which the pin extends; and the pin having a body and head, the retainer being spaced from the wall such that the head of the pin is between the retainer and the wall when the pin is installed.

2. The improved assembly of claim 1 wherein the retainer is integrally formed with the housing.

3. The improved assembly of claim 1 wherein the retainer is resilient.

4. The improved assembly of claim 1 wherein the retainer includes a notch through which the pin passes.

5. The improved assembly of claim 1 wherein the retainer includes a flat body and support legs extending from the body.

6. The improved assembly of claim 1 wherein the retainer is free from additional hardware.

7. A door handle assembly, comprising:

a housing;

a handle;

a one piece pin for pivotally connecting the handle to the housing by extending through aligned apertures in the housing and handle;

a pin retention member extending from the housing for retaining the pin against longitudinal removal from the handle, the pin being inserted in a first direction past the retainer to prevent longitudinal movement of the pin in an opposite second direction;

the housing including a wall with one of the aperture through which the pin extends; and the pin having a body and a head, the pin retention member being spaced from the wall such that the head of the pin is between the pin retention member and the wall when the pin is installed.

8. The assembly of claim 7 wherein the pin retention member is a tab having a surface to retentively engage the pin.

9. The assembly of claim 7 wherein the housing and pin retention member have one-piece molded construction.

10. The assembly of claim 7 wherein the pin retention member is flexible.

11. The assembly of claim 7 wherein the pin retention member has a recess through which the pin passes.

12. The assembly of claim 7 wherein the pin retention member includes a planar body with angularly disposed support legs.

13. The assembly of claim 7 wherein the pin is inserted through the handle and housing and retained by the retention member in a single step.

14. The assembly of claim 7 wherein the pin is held in position by the retention member without the use of hardware.

15. The assembly of claim 7 wherein the pin is assembled to the housing and handle in a single step.

16. The door handle assembly of claim 7 wherein the pin retention member resides on only one end of the pin.

17. The door handle assembly of claim 7 the retainer includes a passageway smaller than the pin head, whereby the pin head is adapted to be pushed in a first direction through the passageway and past the retainer and then be precluded from unintentionally moving in an opposite direction through the passageway and past the retainer.

* * * * *